United States Patent [19]

Rose

[11] 4,156,265

[45] May 22, 1979

[54] SAFETY SOCKETS AND LOADS

[76] Inventor: Manning I. Rose, 2301 Glenheath, Dayton, Ohio 45440

[21] Appl. No.: 770,568

[22] Filed: Feb. 22, 1977

[51] Int. Cl.[2] ..... H01R 13/44

[52] U.S. Cl. ..... 361/179; 339/12 L; 200/51.09; 339/12 R; 200/51 R

[58] Field of Search ..... 361/179; 200/51.09, 200/51.1; 339/12 L, 12 R; 335/2, 132, 202, 205

[56] References Cited

U.S. PATENT DOCUMENTS

| | | | |
|---|---|---|---|
| 2,788,501 | 4/1957 | Buquor et al. | 339/12 L |
| 3,144,527 | 8/1964 | Tolegian | 200/51.09 |
| 3,159,725 | 12/1964 | Dennis | 200/51.09 |
| 3,496,500 | 2/1970 | Romary | 335/205 |
| 3,521,216 | 7/1970 | Tolegian | 339/12 L |
| 3,945,139 | 3/1976 | Miller | 335/205 X |
| 4,008,403 | 2/1977 | Rose | 200/51.09 X |

*Primary Examiner*—Patrick R. Salce
*Attorney, Agent, or Firm*—Dybvig & Dybvig

[57] ABSTRACT

Load and socket arrangements are disclosed wherein contacts within a socket are connected to an electrical energy source by a magnetic reed switch responsive to magnetic material carried by the load. The socket is disconnected from the source and incapable of producing electrical shock when the load is removed. In one embodiment, a lamp has a magnetic insulator separating its shell and base terminals. In another embodiment, a connector plug has a magnet carried within the body of the plug. Various sockets and circuits for connecting reed switches in the sockets are disclosed. Also disclosed are magnetic adapters for attachment to conventional lamps or plugs so that conventional loads may be used in the sockets.

21 Claims, 14 Drawing Figures

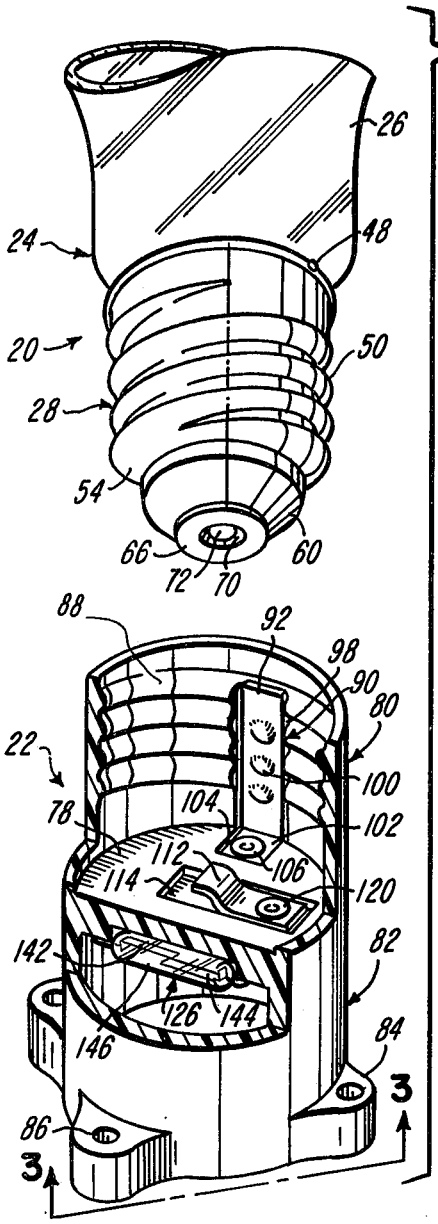
FIG-1
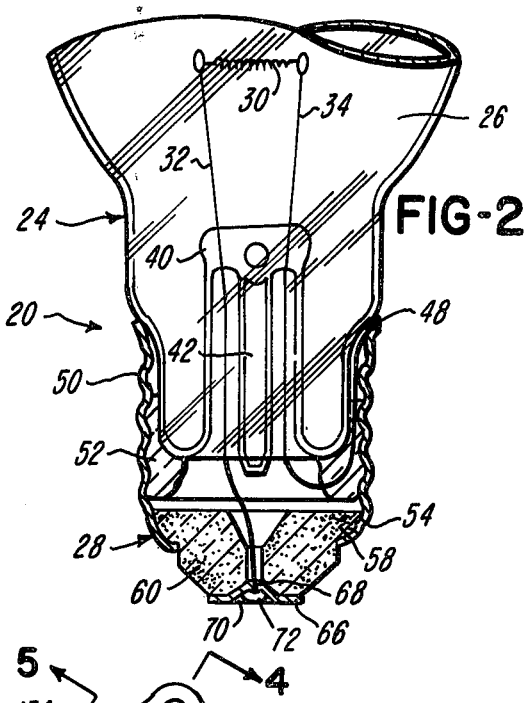
FIG-2
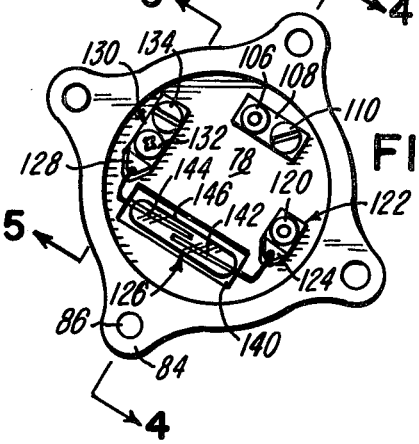
FIG-3
FIG-4
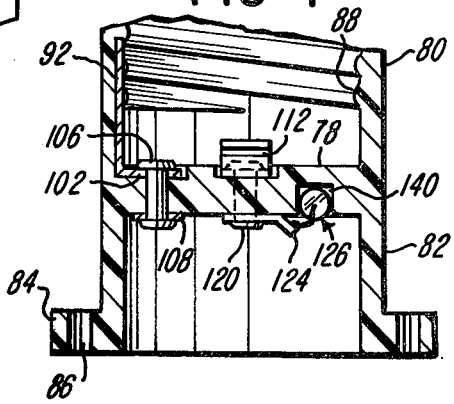
FIG-5
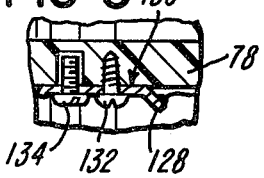
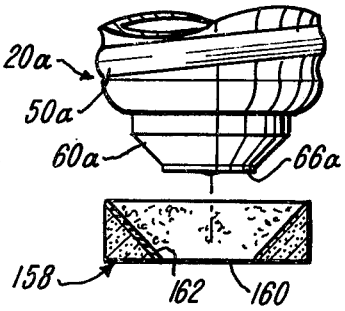
FIG-6

FIG-7
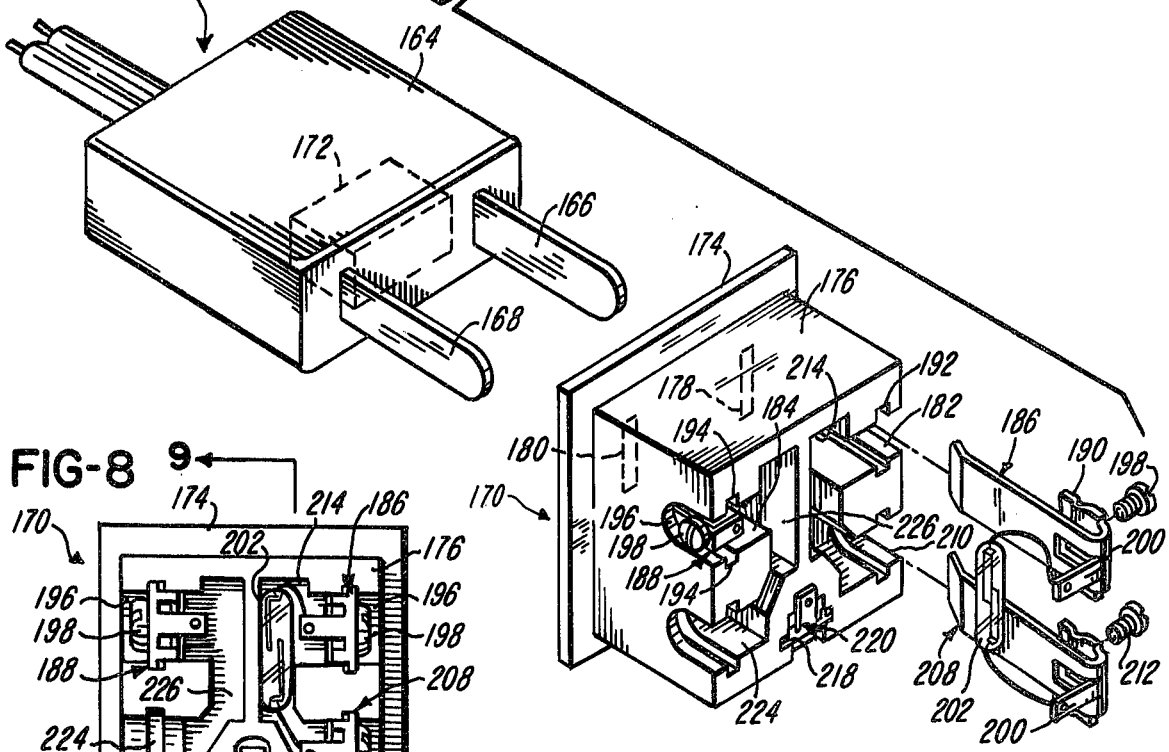
FIG-8
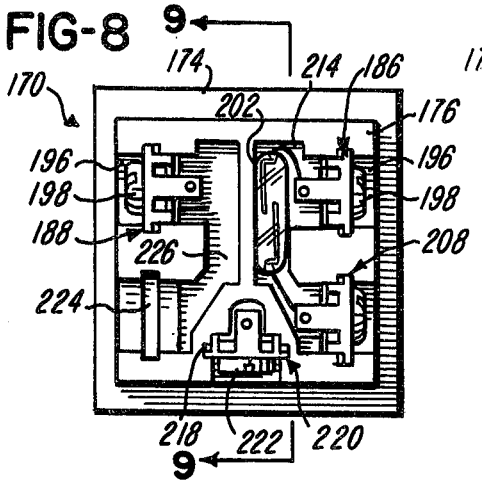
FIG-9
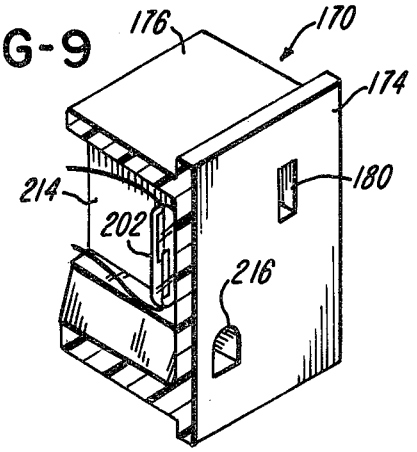
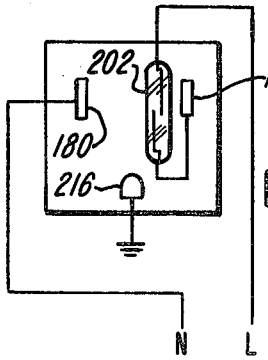
FIG-10
FIG-11
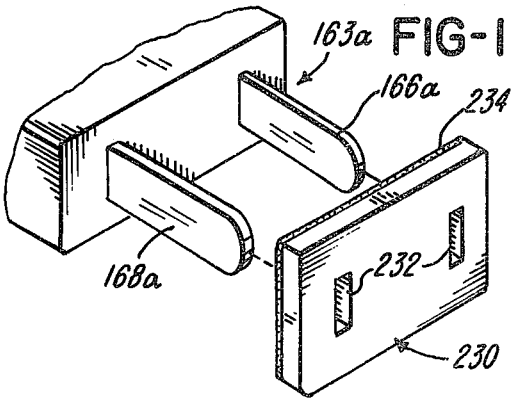

SAFETY SOCKETS AND LOADS

BACKGROUND OF THE INVENTION

1. Field of the Invention

The present invention relates to safety sockets and loads for connection to an electrical energy source.

2. Description of the Prior Art

Sockets for use with loads having magnets, with removal of the loads causing contacts within the sockets to be electrically isolated or disconnected to prevent accidental electrical shock, are known in the art.

One problem associated with the known sockets is their cost of manufacture. Such sockets have contacts that move in the direction of and need to be properly aligned with the field of the load magnets, and that require specially built, rather than conventional, socket components.

A further problem with the known sockets is that they are usable only with specially designed loads that are not suited for use with conventional sockets. It is believed that the resultant lack of interchangeability with conventional loads and sockets has prevented their widespread acceptance.

Another problem with the known sockets is that their moving contacts frequently give rise to arcing which decreases contact life and which makes such sockets unsuitable in environments where combustible gases are present. Although it has been proposed to overcome this particular problem by constructing a sealed chamber during socket assembly, the provision of such a sealed chamber could add considerably to the expense of manufacture.

SUMMARY OF THE INVENTION

A socket in accordance with the present invention has magnetically operated reed contacts electrically connected between one or more of the socket contacts and an electrical energy source. The reed contacts act to keep the socket inoperative, and thus incapable of producing accidental electrical shock, unless a load having magnetic material is inserted into the socket.

In a first embodiment, a socket is constructed for use with an incandescent lamp. The lamp may be conventional except that the insulating member which separates its shell and base terminals is molded from insulating material with dispersed ferromagnetic particles and then magnetized. The use of dispersed ferromagnetic particles enables the insulating member to be made and then assembled onto the lamp in a substantially conventional manner. A reed switch having reed contacts is located beneath load engaging contacts within the socket and is interconnected between one of the socket contacts and the source line of an electrical energy source. The reed switch is responsive to the magnetized insulating member and connects the source to the contact when the load is inserted into the socket and disconnects the contact when the load is removed.

In a second embodiment, a socket or receptacle for use in connecting a two-pronged plug to an electrical energy source has a reed switch connected between one of the load engaging contacts of the receptacle and a source line. A magnet is embedded in the body of the plug adjacent the prongs so that, as in the first embodiment, the contact of the receptacle associated with the reed switch is connected to the source when the plug is inserted into the receptacle and disconnected when the plug is removed.

The use of a reed switch permits conventional sockets to be used in the practice of the present invention without substantial modification. Small reed switches are commercially available that can be conveniently located near the load engaging portion of a conventional socket structure. The alignment of the reed switch is not critical, enabling it to be mounted within or about the socket at almost any location convenient to the manufacturer. It is only necessary that the reed switch be close enough to the magnetic material carried by the load when inserted into the socket that the reed contacts will be within the field of the magnetic material. The terminals of the loads for use with the safety sockets can be essentially conventional and enable the loads to be used with conventional sockets. The invention also provides adapters to enable use of conventional loads with the safety sockets of this invention.

Because the reed switch is responsive to the magnetic material of the load and connects the contacts of the socket to the source only when the load is present, the likelihood that a child or other person could be accidentally shocked by sticking a finger, tool or other object into an open socket is minimized.

A socket in accordance with the present invention also possesses a further safety feature in that it can be made to eliminate arcing in the atmosphere about the socket and thus be used with minimal danger in an atmosphere having combustible gases. A commercially available reed switch may be used that has its reed contacts sealed within a glass envelope, and any arcing between the reed contacts occurs only within the sealed envelope.

BRIEF DESCRIPTION OF THE DRAWINGS

FIG. 1 is an exploded, fragmentary, perspective view of a lamp and socket made in accordance with the present invention with portions of the socket broken away to expose details of construction.

FIG. 2 is a fragmentary, elevational view, with portions sectioned, illustrating various details in the construction of the lamp of FIG. 1.

FIG. 3 is a bottom plan view of the socket of FIG. 1 taken from the direction of the arrows 3—3 in FIG. 1.

FIG. 4 is a fragmentary, sectional view of the socket of FIG. 1 taken along the line 4—4 of FIG. 3.

FIG. 5 is a fragmentary, sectional view of the socket of FIG. 1 taken along the line 5—5 of FIG. 3.

FIG. 6 is a sectional view of a magnetic adapter for a lamp and illustrates a portion of the base of a conventional lamp to which the adapter could be attached for use with the socket shown in FIG. 1.

FIG. 7 is an exploded perspective view of a plug and receptacle made in accordance with the present invention.

FIG. 8 is a rear elevational view of the receptacle shown in FIG. 7 with its parts assembled.

FIG. 9 is a perspective view showing the front of the same receptacle, broken away to expose details of construction.

FIG. 10 is a schematic view of the receptacle of FIG. 7 showing the electrical connections to the receptacle contacts.

FIG. 11 is a perspective view of a magnetic adapter for a plug and the portion of a conventional plug to which the adapter could be attached for use with the receptacle of FIG. 7.

DESCRIPTION OF THE PREFERRED EMBODIMENTS

Figure 12:
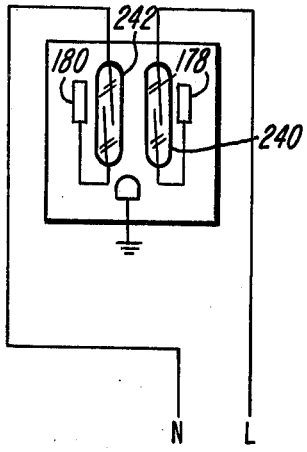
FIGS. 12, 13 and 14 are schematic views similar to FIG. 10, each illustrating other modes of electrical connections to the receptacle contacts.

With reference to FIGS. 1 through 5, an incandescent lamp 20 and a lamp socket 22 illustrate a first embodiment of a load and socket in accordance with the present invention. The lamp 20 has an upper bulb portion 24 which is enclosed by a glass bulb or enclosure 26 and a lower base portion 28. As seen in FIG. 2, a light emitting filament 30 is supported by two wires 32 and 34 that extend through and are supported by a stem 40 integral with the base of the glass bulb 26 and having the usual evacuation tube 42. The wire 34 is electrically connected, such as by welding, at a location, designated 48, near the top of a helically grooved or threaded cylindrical shell terminal 50 secured to the base of the bulb 26 by adhesive 52. The terminal 50 has a bottom edge 54 swaged to engage and securely hold a lip or rim 58 of an annular, nonconductive member 60 which is typically made from ceramic, glass, porcelain or other insulating material. The annular member 60 serves as an insulating spacer or separation between the cylindrical terminal 50 and a center base terminal 66 formed by a conductive disc attached to the base of the annular member 60. The base terminal 66 has a centrally located hole 68 through which the wire 32 extends and a recess or dimple 70 to which the end of the wire 32 is electrically connected by solder 72.

While the bulb structure as thus far described is entirely conventional, the member 60 in accordance with this invention differs from its counterpart in conventional lamps. Prior to the modling of the ceramic or other insulating material to form the member 60, a quantity of iron or other ferromagnetic particles, insufficient to render member 60 conductive, is dispersed throughout the nonconductive material from which member 60 is molded. After molding and either before or after assembly onto the lamp 20, the member 60 is subjected to a strong magnetic field and the dispersed ferromagnetic particles thereby permanently magnetized. As will be described below, the magnetized particles are used to influence a magnetic reed switch when the lamp 20 is inserted into the socket 22.

The socket 22 includes a generally cylindrical housing which may be molded in one piece from a nonconductive plastic and which is hollow except for a transversely extending, centrally located contact supporting plate or wall 78 that divides the housing into an open, lamp receiving upper housing portion 80 and a lower housing portion 82. Plural mounting tabs 84 having apertures 86 for receiving screws (not shown) or other fastening means may be provided on lower housing portion 82.

As is conventional, the interior surface 88 of the upper portion 80 is threaded for receiving and engaging the threaded lamp terminal 50 to mechanically secure the lamp in the socket.

An L-shaped strip of conductive spring metal forming a side contact 90 has a vertically extending longer leg 92 located in an elongated recess 98 in the threaded surface 88. The longer leg 92 has raised portions or ridges 100 to engage the terminal 50 and assure electrical contact between the side contact 90 and the cylindrical lamp terminal 50.

The side contact 90 has a shorter leg 102 located in a recess 104 in the top surface of the support plate 78. The side contact 90 is held in position by a rivet 106 that electrically connects the side contact 90 to a terminal plate 108 (FIGS. 3 and 4) which the rivet 106 also affixes to the underside of the support plate 78. A terminal screw 110 threadedly engages the terminal plate 108 for attaching a return line from a household electrical circuit to the terminal plate 108 and, by way of rivet 106, to the side contact 90. A base contact 112 is held in a recess 114 in the top surface of the support plate 78 by a rivet 120. The free end of the base contact 112 is bent upwardly and is centrally positioned for engagement with the lamp base terminal 66.

Those familiar with socket constructions will realize that the parts of the socket as thus far described are conventional and, as will become apparent, can be constructed in various conventional configurations other than the configuration illustrated.

In accordance with this invention and as seen best in FIGS. 3 and 4, the base contact 112 is mechanically and electrically connected to a conductive plate 122 by the rivet 120, the conductive plate 122 also being attached to the underside of the support plate 78 by the rivet 120. A downwardly bent end portion 124 of the conductive plate 122 extends away from support plate 78 and is electrically connected by solder or other suitable means to one lead of a magnetic reed switch 126. The other lead of the reed switch 126 is connected to a downwardly bent end portion 128 of a second terminal plate 130. As seen most clearly in FIG. 5, the terminal plate 130 is secured to the support plate 78 by a self-tapping screw 132. The terminal plate 130 threadedly receives a terminal screw 134 for connecting the terminal plate 130 to a source line from a household electrical circuit.

The reed switch 126 is located within a recess 140 formed within the underside of support plate 78. The wire leads of the reed switch are sufficiently stiff to retain the reed switch within the recess 140, but, if desired, other suitable means, such as a retention strap or bracket, (not shown) could also be used to hold the reed switch within the recess. The reed switch may be conventional in structure and has two reed contacts 142 and 144 enclosed within a sealed glass envelope 146 and attracted to each other in the presence of a magnetic field. The location of the reed switch 126 is close enough to the lamp receiving upper portion 80 of the socket that, when the lamp 20 is inserted into the socket, the magnetic member 60 will cause the reed contacts to be attracted to each other and close.

In operation, the reed switch 126 greatly reduces the probability that a person touching the base contact 112 with a finger, tool or other object will receive a shock. One would not, of course, receive a shock by touching the side contact 90 since it is connected to the return line. When the lamp 20 is not in the socket, the reed contacts 142 and 144 are open and current cannot flow from the source line terminal plate 130 to the base contact 112. When the lamp 20 is inserted into the socket, the magnetic insulating member 60 is brought close enough to the reed switch 126 to cause the reed contacts 142 and 144 to close. The base contact 112 is thereby connected to the source line and remains connected so long as the lamp 20 is in the socket.

Lamp 20 and socket 22 may be interchanged and used with conventional lamps and sockets with little difficulty. The lamp 20, since its terminals and external shape are identical to the terminals and shape of a conventional lamp, can be used freely in any conventional socket adapted for use with lamps having a center base terminal and threaded cylindrical shell terminal.

Likewise, the shape of side contact 90, base contact 112, and the threaded surface 88 are such that the socket 22 can receive any conventional lamp having a center base terminal and a threaded cylindrical shell terminal. However, a conventional lamp does not carry magnetic material necessary to render socket 22 operative. For purposes of easily adapting a conventional lamp for use in socket 22, this invention provides a magnetic adapter 158, shown in FIG. 6, for use with a conventional lamp 20*a* having a threaded cylindrical terminal 50*a*, a center base terminal 66*a*, and an insulating member 60*a* separating the terminals 50*a* and 66*a*. The adapter 158 may be made of the same magnetic material as member 60 and comprises an annular body having a tapered through bore 160. The surface 162 of the bore 160 is shaped and sized to conform to the exposed surface of the lamp insulating member 60*a*. For typical lamps, the bore surface 162 would be generally conical as illustrated.

The surface 162 is coated with a layer of contact adhesive so that it may be readily assembled onto the lamp 20*a* simply by pressing the load engaging top surface 162 against the lamp insulator member 60*a*. The smaller diameter end of the bore 160 is larger than the diameter of the lamp base terminal 66*a* so that the base terminal may pass through the adapter for engagement with base contact 112 of the socket. The outer diameter of the adapter 158 may be essentially the same as or less than the base diameter of the lamp cylindrical terminal 50*a*, and the depth of the adapter 158 may be the same or less than the vertical projection of the lamp insulator member 60*a* so that the adapter will fit snugly against the bottom of the lamp 20*a* and into the socket without interferring with the engagement between the lamp terminals and the socket contacts. The exact dimensions of the adapter 158 will, of course, depend upon the dimensions of the lamp and socket.

While the first embodiment described above shows one preferred form of the present invention, it should be realized that other types of lamps and sockets, including arc lamps, glow lamps, mercury vapor lamps, and flourescent lamps, could be used as well. In addition, other types of electrical loads and other types of sockets for connecting such loads to electric energy sources can also be used in the practice of the present invention.

A second embodiment shown in FIGS. 7 through 11 is illustrative of another kind of load and socket. The load includes a plug 163 having a molded rubber or plastic body 164 with two projecting prongs 166 and 168 serving as terminals for insertion into a socket or receptacle 170. A magnet 172, shown in phantom in FIG. 7, is embedded in the body of the plug.

The receptacle 170 may comprise a molded plastic body having a front face plate 174 backed by a generally rectangular housing 176. The face plate 174 has a pair of rectangular apertures 178 and 180 extending therethrough sized to receive the load terminal prongs 166 and 168. The housing 176 is provided with pockets 182 and 184 extending therethrough which are aligned with and open into the face plate apertures 178 and 180, respectively. The pockets 182 and 184 are adapted to receive identical spring metal contact clips comprising a right side contact clip 186 and a left side contact clip 188, respectively, that have ears 190 for frictionally engaging surfaces of the housing 176 that define notches 192 and 194 extending along the pockets 182 and 184, respectively. The opposite sides of the housing have slots 196 to permit access to terminal screws 198 that may be threadedly received by apertures (not shown) in the contact clips 186 and 188. When the prongs 166 and 168 of the plug 163 are fully inserted into the receptacle 170 they will snugly engage and thus make good electrical contact with the contact clips 186 and 188. The terminal screw 198 associated with the contact clip 188 is intended to be used to connect a return line from a household electrical circuit to the contact clip in a manner well known in the art. The terminal screw 198 associated with the other contact clip 186 is nonfunctional for reasons which will become apparent and may optionally be omitted.

The contact clips 186 and 188 have solder tabs 200 struck therefrom that extend generally perpendicular to the plane of the main body of the contact clips. In accordance with this invention one lead of a magnetically operated reed switch 202 is connected to the solder tab 200 of the right side contact clip 186 and the other lead is connected to a solder tab 200 projecting from a terminal clip 208. The clip 208 is preferably identical to the contact clips 186 and 188 and is adapted to be snugly received within a pocket 210. The pocket 210 can conveniently be identical to the pocket 182. However, the body of the fact plate 174 is continuous across the front end of the pocket 210 so that there is no access to the pocket 210 and clip 208 from the front of the receptacle 170. A terminal screw 212 that is threadedly received in an aperture (not shown) in the clip 208 is adapted to connect the clip 208 to a source line from a household electrical circuit.

The receptacle housing 176 has a recess 214 extending to the front face plate 174 for receiving the reed switch 202 and its associated lead wires. Preferably, the reed switch 202 is located immediately behind the face plate 174 as illustrated in FIG. 9 so that it will be in the field of the magnet 172 when the plug 163 is inserted into the receptacle 170. As in the first embodiment, the lead wires of the reed switch may be made sufficiently stiff to hold the reed switch in place within recess 214, but if preferred, other suitable means such as a strap or bracket (not shown) could also be used to retain the reed switch in place.

The operation of the structure described above is believed apparent from the foregoing description. Briefly, when there is no plug in the receptacle 170, the reed contacts are open and, although the source line is connected to the terminal clip 208, no current can flow to the contact clip 186. Accordingly, the receptacle is inoperative and the insertion of a sharp metal tool or other conductive object, assuming it is not sufficiently magnetized to influence the reed switch 202, into the prong receiving aperture 178 will not result in an electric shock. Since the contact clip 188 associated with the prong receiving aperture 180 is connected to the return line, there will, of course, be no shock resulting from touching that contact clip by a conductive object.

When the plug 163 is inserted into the receptacle 170 and the prongs 166 and 168 make electrical contact with the contact clips 186 and 188, the body portion 164 of the plug is near enough to the front face 174 of the receptacle that the magnet 172 influences the reed switch 202 and causes its reed contacts to close. The prong 166, which is in engagement with the contact clip 186, is then electrically connected by way of the reed switch 202 to the source line.

FIG. 10 schematically illustrates the assembly of the receptacle as described above with the connection of the source line, designated L, to the right contact clip associated with aperture 178 by the reed switch 202, and the connection of the return or neutral line, designated N, directly to the left contact clip associated with aperture 180.

There is a third aperture, designated 216, in the face plate 174 for receiving a conventional grounding prong (not shown). The aperture 216 opens to a pocket 218 that receives still another contact clip 220 that may be identical to the clips described above. A terminal screw 222 is adapted to connect the contact clip 220 associated with aperture 216 to a grounding wire as shown schematically in FIG. 10.

The receptacle housing 176 is provided with another pocket 224 and another recess 226 such that the housing is symmetrical with respect to its vertical centerline. The pocket 224 and the recess 226 are empty in the embodiment shown in FIGS. 7–10.

While the illustrated plug 163 is shown with its carried magnetic material comprising the embedded magnet 172, it will be appreciated that the magnet could be formed as in the first embodiment by molding the body portion 164 of the plug with dispersed ferromagnetic particles.

As in the first embodiment illustrated in FIGS. 1–6, plug 163 and receptacle 170 may be interchanged with conventional plugs and receptacles with little difficulty. The plug 163 and its prongs 166 and 168 are so constructed that they can be inserted into any conventional receptacle for use with a two- or three-pronged plug.

Likewise, the receptacle housing and contacts in the receptacle 170 are so constructed to receive any conventional two- or three-pronged plug. However, as in the first embodiment, a magnetic adapter is necessary to render the receptacle 170 operative. In FIG. 11, a magnetic adapter 230 having a flat, rectangular body is shown ready for attachment to a conventional two-pronged plug 163*a*. The adapter has two rectangular openings 232 through which the prongs 166*a* and 168*a* of the plug 163*a* extend and may have a coating of contact adhesive 234 on one surface for securing the adapter to the plug.

A second reed switch can be mounted in the receptacle 170 by using the empty recess 226, and another terminal clip can be inserted into the empty pocket 224. The use of a second reed switch and alternate modes for connecting the receptacle 170 to an electrical energy source are schematically illustrated in FIGS. 12–14.

In the receptacle illustrated in FIG. 12, the load engaging contact clip associated with receptacle opening 178 is connected to the source line L by a reed switch 240, and the load engaging contact clip associated with receptacle opening 180 is connected to the return or neutral line N by a reed switch 242. Before a plug is inserted into the receptacle, the reed contacts in both reed switch 240 and reed switch 242 are open and both the source and return lines are disconnected from the load engaging contact clips. When a plug is inserted into the receptacle, the magnetic material carried by the plug closes both reed switches and both the return and source lines are then electrically connected to the contact clips.

Figure 13:
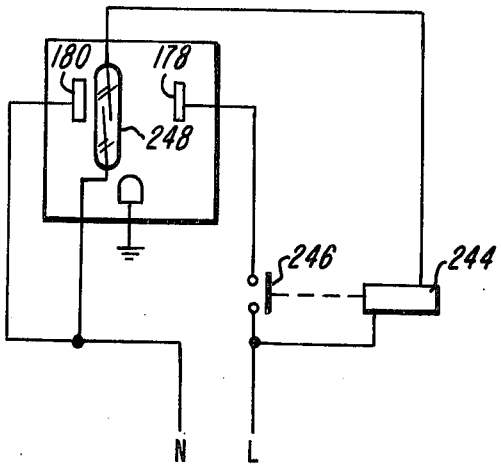

In the receptacle illustrated in FIG. 13, a relay 244 operates a controlled switch 246 that is interposed between the source line L and the contact clip associated with aperture 178. The relay 244 is connected between the source line L and the return line N by a reed switch 248. The reed switch 248 closes when a plug with magnetic material is inserted into the receptacle which, in turn, actuates relay 244 to close the switch 246 and connect the source line to the contact clip associated with aperture 178.

Figure 14:
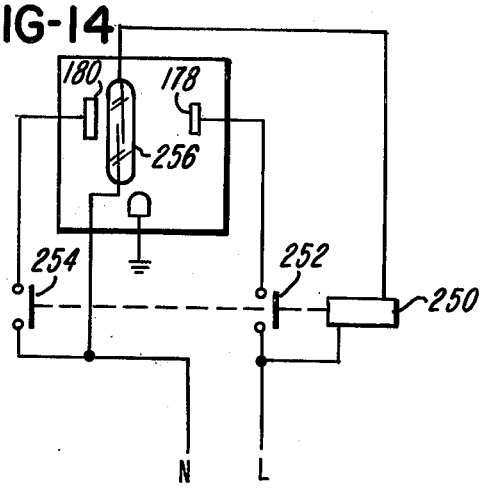

In FIG. 14, the receptacle is illustrated having a relay 250 which operates two controlled switches 252 and 254. The switch 252 is interposed between the source line L and the contact clip associated with aperture 178, and the switch 254 is interposed between the return line N and the contact clip associated with aperture 180. The relay 250 is connected between the source line and the return line by a reed switch 256. When a plug with magnetic material is inserted into the receptacle and reed switch 256 closes, relay 250 is actuated and it closes both switches 252 and 254 to connect both the source and return lines to the contact clips.

Although the various electrical connections illustrated in FIGS. 12 through 14 are shown in a plug receiving receptacle, it should be apparent that similar connections could be made in the lamp receiving socket illustrated in FIGS. 1 through 5.

Although the presently preferred embodiments of this invention have been described, it will be understood that within the purview of this invention various changes may be made in the scope of the appended claims.

Having thus described my invention, I claim:

1. In a load and socket arrangement wherein said load has a lamp base type cylindrical shell terminal and a lamp base type center base terminal, wherein said socket has a lamp socket type side contact for engaging said cylindrical shell terminal and a lamp socket type base contact for engaging said base terminal, and wherein said socket includes means connecting said socket to an electrical energy source, the improvement wherein said load includes magnet means and said connecting means includes a magnetic reed switch responsive to said magnet means for disconnecting said socket from said source when said load is removed from said socket.

2. The improvement of claim 1 wherein said source includes a source line and a return line, and wherein said reed switch is interconnected between said one of said socket contacts and said source line.

3. The improvement of claim 2 wherein said connecting means includes a second reed switch interposed between the other of said socket contacts and said return line.

4. The improvement of claim 1 wherein said load has a nonconductive portion separating said cylindrical shell terminal and said center base terminal and wherein said magnet means is located in said nonconductive portion.

5. In a socket for connecting a load having magnet means to an electrical energy source, said socket comprising a generally cylindrical lamp receiving socket having a side contact for engaging a cylindrical shell terminal of a lamp and a base contact for engaging a center base terminal of said lamp, the improvement wherein said socket includes reed means comprising a reed switch located in said socket to be within the field of said magnet means when said lamp is inserted into said socket for disconnecting said socket from said source when said load is removed from said socket.

6. The improvement of claim 5 wherein said socket includes a central wall dividing said socket into an upper, lamp or the like load receiving portion and a lower portion, and wherein said reed switch is located on the underside of said central wall.

7. The improvement of claim 5 wherein said socket includes a first socket terminal for connecting said base contact to a source line of said source and a second socket terminal for connecting said side contact to a return line of said source and wherein said reed switch is electrically interconnected between said first socket terminal and said base contact.

8. In a lamp for use in a socket having magnetically operable means, said lamp having two terminals and a nonconductive portion separating said two terminals, one of said terminals comprising a cylindrical shell terminal and the other of said terminals comprising a center base terminal, at least one of said terminals engaging said socket to mechanically secure said lamp in said socket, the improvement wherein said nonconductive portion comprises an annular member including magnet means between said shell terminal and said base terminal.

9. The lamp of claim 8 wherein said magnet means comprises ferromagnetic particles dispersed in said nonconductive portion.

10. An adapter for attachment to a load for use in a socket having magnet responsive means for connecting said socket to an electrical energy source, comprising:

a body of insulating material, said body having an annular shape with a bore so that said adapter may be attached to an insulating member separating a conventional cylindrical shell terminal and a conventional center base terminal of a lamp, with said center base terminal passing through said bore;

magnet means carried by said body; and means for securing said body to said load.

11. The adapter of claim 10 wherein said means securing comprises contact adhesive on said body.

12. The adapter of claim 10 wherein said magnet means comprises ferromagnetic particles dispersed in said body.

13. For use with an electrical lamp socket having a center base socket contact and a side socket contact, the socket contacts being adapted to be engaged by the center base terminal and cylindrical terminal of a lamp or the like, the socket further having magnetically operated means for connecting at least one of the socket contacts to an electrical energy source, an adapter for enabling the use of a conventional lamp or the like with said socket comprising:

a nonconductive body at least a portion of which is magnetized, said body being sized and shaped to be connected to the base of a lamp or the like without interferring with the insertion of the lamp in the socket and the engagement of the lamp terminals with the socket contacts; and means for securing said body to the base of a lamp.

14. The adapter of claim 13 wherein said adapter has a surface conforming to the exposed surface of an insulating member between the base terminal and the cylindrical terminal and wherein said means for securing said adapter to said lamp base comprises a layer of contact adhesive on said surface.

15. The adapter of claim 14 wherein said adapter has an annular body with a bore having a minimum diameter greater than the diameter of a conventional lamp base terminal, wherein said surface of said adapter is formed by said bore, and wherein the diameter of said adapter being no greater than the base diameter of the cylindrical terminal of the lamp with which the adapter is to be used.

16. An adapter for attachment to a load for use in a socket having magnet responsive means for connecting said socket to an electrical energy source, comprising:

a body of insulating material, said body being flat with two openings so that said adapter may be attached to a conventional connector plug having at least two prong-type terminals;

magnet means comprising ferromagnetic particles dispersed in said body; and means for securing said body to said load.

17. The adapter of claim 16 wherein said means securing comprise contact adhesive on said body.

18. In a load and socket arrangement wherein said load has two terminals, wherein said socket has two socket contacts positioned and shaped for engagement by said load terminals so that said load terminals may be inserted into said socket, wherein said socket has a pair of socket terminals connected to said socket contacts and means for connecting said socket terminals and accordingly said load to an electrical energy source, and wherein said socket has a nonconductive body portion facing said load terminals as they are being inserted into engagement with said socket contacts, the improvement wherein said load includes magnet means and said connecting means includes a magnetic reed switch responsive to said magnet means for disconnecting said socket terminals from said source when said load is removed from said socket, and means mounting said reed switch within said socket adjacent said nonconductive body portion with said nonconductive body portion located between said reed switch and said magnet means.

19. In a socket for connecting a load to an electrical energy source, said load having a body, two terminals mounted on said body and having magnet means in said body, said socket being of a type having socket contacts engaged by said terminals upon insertion of said terminals into said socket and having insulating means facing said load body when said terminals are inserted into said socket, the improvement wherein said socket includes reed means responsive to said magnet means to disconnect said socket from said source when said terminals are removed from said socket, said reed means comprising a reed switch mounted adjacent said insulating means.

20. In a load and socket arrangement wherein said load is of the type comprising a connector plug with prong type conductive terminals, wherein said socket is of the type having receptacle contacts for engagement by said prong type terminals, wherein said socket includes socket terminal means for connection to an electrical energy source, and wherein said load is connected by said socket terminal means to said source through said receptacle contacts, said socket having body means defining a face apertured to expose said receptacle contacts, the improvement wherein said connector plug houses magnet means mounted adjacent the surface of said plug from which said prong type terminals extend and said socket includes magnetic reed means comprising a magnet reed switch mounted behind said face in position to be responsive to said magnet means and disconnecting said one of said receptacle contacts from said source when said plug is removed from said socket.

21. In a socket for connecting a load having magnet means to an electrical energy source, said socket comprising a receptacle having receptacle contacts for engagement by prong type terminals of a connector plug, face plate means having apertures through which said terminals may be inserted for engagement with said receptacle contacts, the improvement wherein said socket includes reed means responsive to said magnetic means to disconnect said socket from source when said load is removed from said socket, said reed means comprising a reed switch located within said receptacle adjacent said face plate means to be within the field of said magnet means when said plug terminals are engaged with said receptacle contacts.

* * * * *